US006868606B2

(12) United States Patent
Friese

(10) Patent No.: US 6,868,606 B2
(45) Date of Patent: Mar. 22, 2005

(54) METHOD AND APPARATUS FOR MAKING A ROTATION-SYMMETRICAL GEAR MEMBER

(75) Inventor: Udo Friese, Ahlen (DE)

(73) Assignee: WF-Maschinenbau und Blechformtechnik GmbH & Co. KG, Sendenhorst (DE)

( * ) Notice: Subject to any disclaimer, the term of this patent is extended or adjusted under 35 U.S.C. 154(b) by 0 days.

(21) Appl. No.: 10/294,359

(22) Filed: Nov. 14, 2002

(65) Prior Publication Data

US 2003/0093901 A1 May 22, 2003

Related U.S. Application Data

(60) Provisional application No. 60/335,852, filed on Nov. 16, 2001.

(51) Int. Cl.[7] ..... B21D 53/28; B23P 15/14

(52) U.S. Cl. ..... 29/893.32; 29/893; 29/893.3; 29/893.36; 72/110; 72/111

(58) Field of Search ..... 29/893.32, 893.34, 29/893.3, 893.36, 893; 72/68, 110, 111

(56) References Cited

U.S. PATENT DOCUMENTS

| | | | | | |
|---|---|---|---|---|---|
| 2,654,944 | A | * | 10/1953 | Wilson | 29/893.34 |
| 4,796,345 | A | * | 1/1989 | Krapfenbauer | 29/893.32 |
| 4,945,783 | A | * | 8/1990 | Grob | 74/460 |
| 5,237,745 | A | * | 8/1993 | Yamanaka | 29/893.34 |
| 5,310,432 | A | * | 5/1994 | Fukui et al. | 148/330 |
| 5,562,785 | A | * | 10/1996 | Yamanaka | 148/573 |
| 5,699,689 | A | * | 12/1997 | Yamanaka | 72/68 |
| 5,737,955 | A | * | 4/1998 | Ohya et al. | 72/102 |
| 5,774,986 | A | * | 7/1998 | Nishimura et al. | 29/893.32 |
| 5,809,649 | A | * | 9/1998 | Kostermeier | 29/893.32 |
| 5,826,452 | A | * | 10/1998 | Reichhardt | 72/69 |
| 5,904,060 | A | * | 5/1999 | Kanemitsu et al. | 72/110 |
| 5,927,121 | A | * | 7/1999 | Rolf et al. | 72/68 |
| 6,016,602 | A | * | 1/2000 | Kanemitsu et al. | 29/893.32 |
| 6,161,409 | A | * | 12/2000 | Friese | 72/110 |
| 6,223,576 | B1 | * | 5/2001 | Mashita | 72/102 |
| 6,330,836 | B1 | * | 12/2001 | Watanabe et al. | 74/434 |
| 6,470,724 | B1 | * | 10/2002 | Friese | 72/84 |
| 6,484,401 | B1 | * | 11/2002 | Specht | 29/893.32 |

FOREIGN PATENT DOCUMENTS

| | | | | |
|---|---|---|---|---|
| DE | 4321779 A1 | * | 2/1994 | B21H/5/00 |
| GB | 2115726 A | * | 9/1983 | B21D/53/26 |

* cited by examiner

*Primary Examiner*—Essama Omgba
(74) *Attorney, Agent, or Firm*—Henry M. Feiereisen

(57) ABSTRACT

In a method of making a rotation-symmetrical gear member, an outer edge of a circular blank is shaped to form a concentric thickened area which extends in axial direction to thereby realize a ring structure. A remaining area of the circular blank is then shaped into a cap-like structure through application of compressive forces by means of a pressure roller such that the ring structure adjoins a sidewall of the cap structure and projects outwardly in radial direction. The ring is then formed with outer teeth in opposition to the sidewall.

6 Claims, 2 Drawing Sheets

Fig. 1
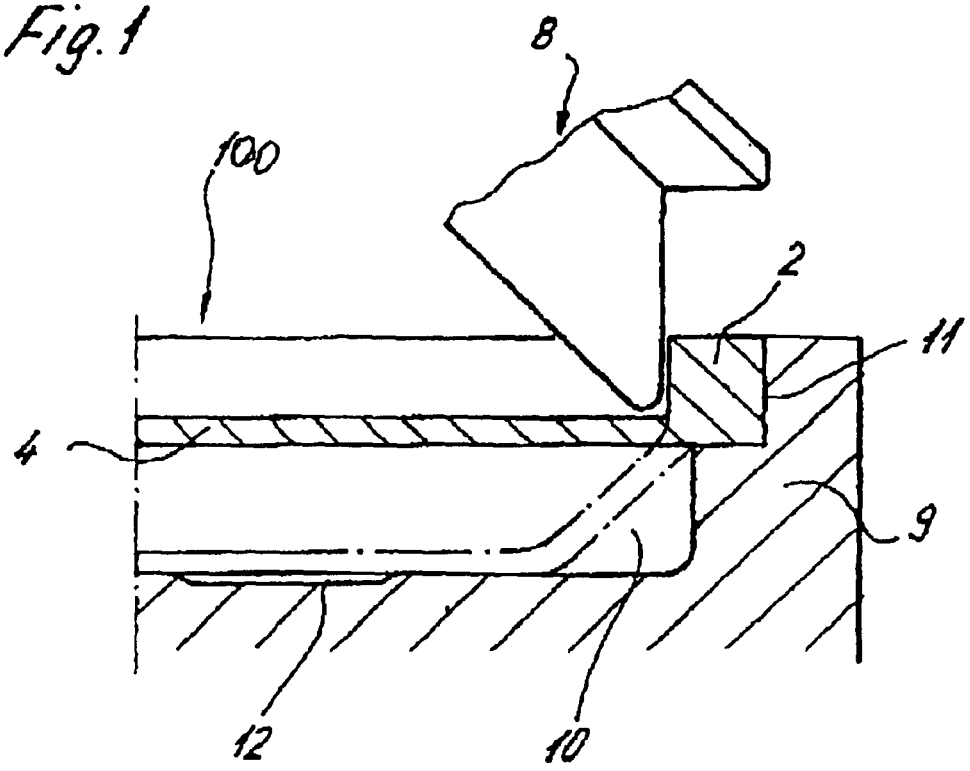
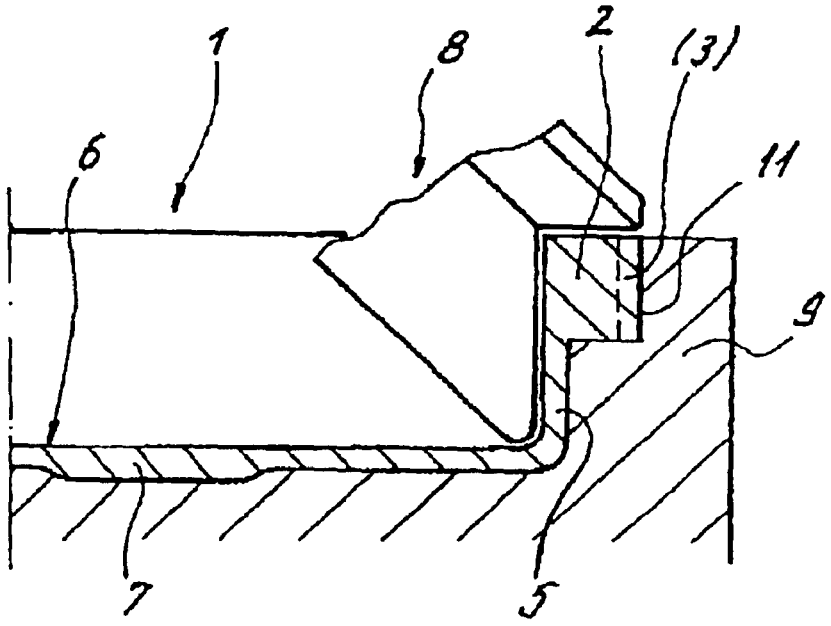
Fig. 2

METHOD AND APPARATUS FOR MAKING A ROTATION-SYMMETRICAL GEAR MEMBER

CROSS-REFERENCES TO RELATED APPLICATIONS

This application claims the benefit of prior filed provisional application, Appl. No. 60/335,852, filed Nov. 16, 2001, pursuant to 35 U.S.C. 119(e), the disclosure of which is incorporated herein by reference.

BACKGROUND OF THE INVENTION

The present invention relates to a method and apparatus for making a rotation-symmetrical gear member.

Gear members of a type involved here are used, e.g., in the automobile industry, for application as so-called starter rings. Currently, the manufacture of such a gear member is realized by forming from a circular blank a cap-like structure, which includes a concentric sidewall extending substantially in axial direction. A ring provided with outer teeth is welded to the outside of this sidewall, typically in the peripheral region of the sidewall, whereby the height of the ring in axial direction is smaller than the height of the sidewall. The resultant free zone of the sidewall is required for operation of sensors or other functional components. It is also known to provide in the sidewall functional window-shaped punchings in the free zone.

This conventional manufacturing process of such gear members suffers, however, significant shortcomings. For one, the manufacture is very complicated, as a consequence of, in particular, the required welding works. Furthermore, the texture of the used material, typically steel, always changes as a result of welding. This may adversely affect the material strength so that the service life of such a gear member is reduced. Moreover, the welding operation results in heat-based deformations that require in part an aftertreatment. Of course, this significantly interferes with the desire for an optimized manufacturing process.

The complexity of the conventional manufacturing process is also detrimental in situations in which gear members should be fabricated as a production article on a large-scale.

It would therefore be desirable and advantageous to provide an improved method for making a gear member, which obviates prior art shortcomings and enables a production of a gear member in a more simple, cost-effective manner and yet improved quality.

SUMMARY OF THE INVENTION

According to one aspect of the present invention, a method of making a rotation-symmetrical gear member, includes the steps of shaping an outer edge of a circular blank to form a concentric thickened area which extends in axial direction to thereby realize a ring structure, shaping a remaining area of the circular blank into a cap-like structure through application of compressive forces by means of a pressure roller such that the ring structure adjoins a sidewall of the cap structure and projects outwardly in radial direction, and forming the ring with outer teeth in opposition to the sidewall.

The present invention resolves prior art problems by using a compression process for manufacturing a gear member through cold-forming in a very simple but yet extremely effective manner. Only very few process steps are required to make the gear member from a circular blank. The need for a welding operation is hereby completely eliminated, so that the drawbacks involving heat-based distortions of the gear member or structural changes in a welded region are of no concern here. Moreover, the method according to the invention substantially shortens the manufacturing times, resulting in significant cost advantages, and enables a single-piece manufacture of the gear member from a circular blank. A separate production of the ring, as required heretofore, is no longer necessary.

While conventional gear members require the application of a milling process to make the outer teeth of the ring structure, referred to in the following description as "ring", the outer toothed surface can now be made according to the present invention also through compression, whereby the ring adjoining the sidewall of the cap-like structure, referred to in the following description as "cap", is pushed by means of the pressure roller into a mold which is configured with an inner toothed surface and embraces the gear member at least on the side. Hereby, material of the thickened area is partially squeezed into the tooth gaps so that the preset tooth configuration is impressed on the ring to thereby form the outer toothed surface.

Furthermore, there is the possibility to shape the bottom of the gear member in accordance with the requirements as far as the material thickness as well as the configuration are concerned.

In order to realize a desired minimization of the wall thickness, as oftentimes demanded for reasons of weight optimization, stiffening creases may be formed for enhancing the stability, whereby the creases, for example, extend radially and are provided in partial areas. Of course, other suitable configurations are conceivable as well.

Hereby, a mold liner, which serves as abutment during shaping of the cap, is provided with respective recesses for receiving material of the cap bottom during compression by the pressing roller.

In case of need, the cap bottom can be made of varying wall thickness along sections thereof, whereby a volume enlargement is initially carried out in one method step, for example, through manufacture of a ring-shaped bump which is shaped to a wall thickening in a further method step, for example, simultaneously with the finishing of the sidewall of the cap.

The cap bottom can be made thinner by providing a central opening in the circular blank through which excess material volume can be pushed by the pressure roller from the outside inwardly during thinning of the wall thickness, while the diameter of this central opening is reduced at the same time.

Of course, there is also the possibility, to pre-fabricate the circular blank with thinner wall thickness, i.e. before being formed onto the ring, by guiding the pressure roller from the inside to the outside while the material stretches at the same time, i.e. the diameter of the circular blank is enlarged.

According to another aspect of the present invention, an apparatus for making a rotation-symmetrical gear member, includes a rotatable pressure roller which is movable in at least one of an axial direction and radial direction, and a rotating mold liner constructed to receive a circular blank having a thickened ring-shaped peripheral area, with the mold liner including a step-shaped recess to define a lower recess portion and an upper recess portion which provides an abutment liner disposed in concentric relationship to the lower recess portion and having an inside diameter which is greater than an inside diameter of the lower recess portion, wherein the abutment liner has a base for support of the circular blank with its peripheral area.

According to another feature of the present invention, the ring is supported on the outside by the mold liner which substantially corresponds in height in this area to the height of the ring.

According to another feature of the present invention, the abutment liner may have an inner toothed surface with axial teeth against which the thickened peripheral area of the circular blank is pushed by the pressure roller.

The depth of the recess corresponds to the height of the sidewall of the cap which the ring adjoins. The base of the recess of the mold liner may be provided with indentations, which are positioned in suitable manner to generate the afore-mentioned stiffening creases or similar reinforcements.

Also, the base of the recess can be shaped in such a manner that the manufacture of the mentioned ring-shaped bump is possible to enable a thickening of the wall strength in the bottom region.

The already mentioned pressure roller, which is provided for shaping the cap and represents a component of the apparatus, can be moved axially and/or radially, suitably from the inside to the outside as well as from the outside to the inside.

Further, the concentric outer ring zone of the mold to form the abutment liner for support of the ring, may be provided with an inner toothed surface to allow material of the ring to be pushed into by means of the pressure roller to thereby form the outer toothed surface.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 1 is a sectional schematic side view of an apparatus in accordance with the present invention for making a rotation-symmetrical gear member, depicting one process step for manufacture of the gear member;

FIG. 2 is a sectional schematic side view of the apparatus of FIG. 1 during another process step.

DETAILED DESCRIPTION OF PREFERRED EMBODIMENTS

Figure 3:
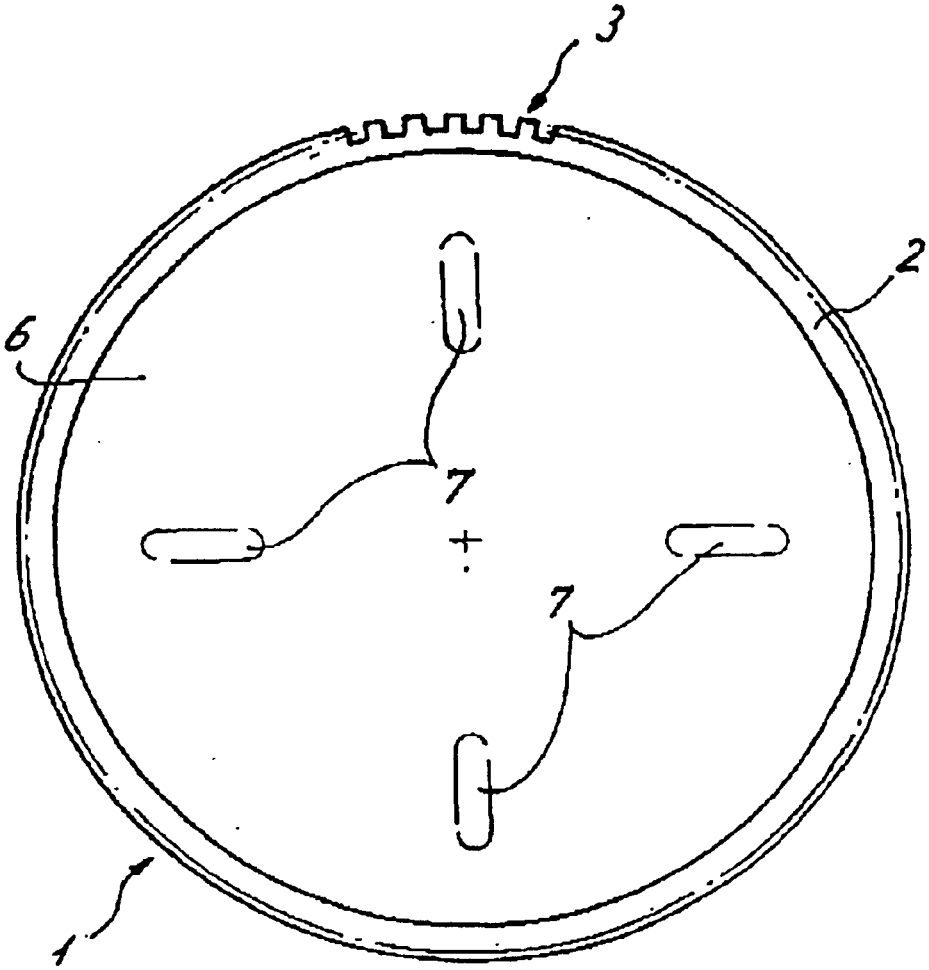
FIG. 3 is a bottom view of a finished gear member made by a method in accordance with the present invention.

Throughout all the Figures, same or corresponding elements are generally indicated by same reference numerals.

Turning now to the drawing, and in particular to FIG. 1, there is shown a sectional schematic side view of an apparatus in accordance with the present invention, generally designated by reference numeral 100, for chipless manufacture of a rotation-symmetrical gear member, generally designated by reference numeral 1 and shown in more detail in FIG. 3. The rotation-symmetrical gear member 1 has hereby an outer peripheral region with a ring 2 provided with outer teeth 3.

The apparatus 100 includes a rotating mold liner 9 with a stepped recess, and a rotatable pressure roller 8 which is movable axially and/or radially. The recess is comprised of a lower recess portion 10 and an upper recess portion, which is disposed in concentric relationship to the recess portion 10 and forms an abutment liner 11. The abutment liner 11 has an inner toothed surface (not shown here in detail) which is evenly spaced about the circumference and provided for formation of the outer teeth 3 of the ring 2, whereby the outer teeth 3 extend in axial direction.

The gear member 1 is made by initially forming the ring 2 in a separate method step. Hereby, the peripheral region of a circular blank 4 is so thickened as to produce a ring 2 in axially extending relationship to the remainder of the circular blank 4. The thus pre-shaped formed product is placed in the mold liner 9 and is supported in the peripheral region, i.e. in the area of the formed ring 2, by the base of the abutment liner 11.

By pressing the pressure roller 8, the circular blank 4 is shaped into a cap-like structure 6, whereby the pressure roller 8 initially engages the area of the ring 2 and is moved axially as well as radially inwards towards the center, so as to produce a configuration, as illustrated in FIG. 1 in dash-dot line, in which the sidewall of the cap 6 extends slantingly.

In a next method step, as shown in FIG. 2, the pressure roller 8 is moved in radial direction from the inside outwards, i.e. in the direction of the ring 2, to shape a sidewall 5 of the cap 6, whereby the respectively designed configuration of the pressure roller 8 pushes at the same time the outer edge of the ring 2 into the inner toothed surface of the abutment liner 11.

During the formation of the cap 6, material is pushed from its bottom into radially directed indentations 12 in the base of the lower recess 10 so as to produce respectively formed creases 7 to realize a stiffening of the cap bottom.

Instead of the chipless tooth formation, it is, of course, also possible to provide in a known manner the outer teeth 11 through milling. Furthermore, the sidewall 5 of the cap 6 may extend at an inclination inwardly from the ring 2 to provide an optimized stacking capability of several gear members.

It is as to possible to provide projections in the sidewall 5 and/or in the transition to the ring 2 so that the ring 2 springs back towards the outside with respect to the sidewall 5.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A method of making a rotation-symmetrical gear member, comprising the steps of:

shaping an outer edge of a circular blank to form a concentric thickened area which extends in axial direction to thereby realize a ring structure;

shaping a remaining area of the circular blank into a cap-like structure through application of compressive forces by means of a pressure roller such that the ring structure adjoins a sidewall of the cap-like structure and projects outwardly in radial direction; and pressing the ring structure by moving the pressure roller in radial direction against an inner toothed surface of an abutment liner to provide the ring structure with outer teeth opposite the sidewall.

2. The method of claim 1, wherein the cap-like structure has a bottom of an initial wall thickness, and further comprising the step of stretching the bottom of the cap-like structure to provide a wall thickness which is smaller than the initial wall thickness at least along predetermined sections.

3. The method of claim 2, wherein the bottom of the cap-like structure is stretched in a manner that the wall thickness is smaller than the initial wall thickness throughout.

4. The method of claim 1, wherein the cap-like structure has a bottom, and further comprising the step of forming the bottom of the cap-like structure with creases for reinforcement during application of the pressure roller.

5. The method of claim 1, wherein the cap-like structure has a bottom of an initial wall thickness, and further comprising the step of partially thickening the bottom of the cap-like structure when compared to the initial wall thickness during application of the pressure roller.

6. A method of making a rotation-symmetrical gear member, comprising the steps of:

shaping an outer edge of a circular blank to form a concentric thickened area which extends in axial direction to thereby realize a ring structure;

shaping a remaining area of the circular blank into a cap-like structure through application of compressive forces by means of a pressure roller such that the ring structure adjoins a sidewall of the cap structure and projects outwardly in radial direction;

forming the ring with outer teeth in opposition to the sidewall; and forming a bottom of the cap-like structure with creases for reinforcement during application of the pressure roller.

* * * * *